US005402944A

United States Patent [19]

Pape et al.

[11] Patent Number: 5,402,944

[45] Date of Patent: Apr. 4, 1995

[54] ELECTRICALLY CONTROLLED FUEL INJECTION PUMP FOR INTERNAL COMBUSTION ENGINES IN PARTICULAR UNIT FUEL INJECTOR

[75] Inventors: Werner Pape, Lyons; François Rossignol, Mornant, both of France

[73] Assignee: Robert Bosch GmbH, Stuttgart, Germany

[21] Appl. No.: 752,495

[22] PCT Filed: Nov. 24, 1990

[86] PCT No.: PCT/DE90/00905

§ 371 Date: Aug. 28, 1991

§ 102(e) Date: Aug. 28, 1991

[87] PCT Pub. No.: WO91/10062

PCT Pub. Date: Jul. 11, 1991

[30] Foreign Application Priority Data

Jan. 3, 1990 [DE] Germany ..... 40 00 044.3

[51] Int. Cl.[6] ..... F02M 39/00

[52] U.S. Cl. ..... 239/88; 239/600

[58] Field of Search ..... 403/338, 335, 342, 353; 239/600, 88–94, 585.1–585.5; 285/356

[56] References Cited

U.S. PATENT DOCUMENTS

| | | | |
|---|---|---|---|
| 293,734 | 2/1884 | Harrison | 403/338 X |
| 2,036,087 | 3/1936 | Chapman | 403/338 X |
| 3,157,407 | 11/1964 | Aulabaugh | 403/338 X |
| 4,474,159 | 10/1984 | Katnik | 239/600 X |
| 4,474,160 | 10/1984 | Gartner | 239/600 X |
| 4,475,516 | 10/1984 | Atkins et al. | 239/600 X |

FOREIGN PATENT DOCUMENTS

| | | | |
|---|---|---|---|
| 3014066 | 10/1981 | Germany | 239/600 |

*Primary Examiner*—Andres Kashnikow
*Assistant Examiner*—Kevin P. Weldon
*Attorney, Agent, or Firm*—Edwin E. Greigg; Ronald E. Greigg

[57] ABSTRACT

An electrically controlled fuel injection pump for internal combustion engines having a pump piston disposed and guided in a pump housing and defining a pump chamber and in its pumping stroke pumping fuel, delivered to this pump work chamber by a feed pump to an injection nozzle as long as a quantity control valve blocks the flow of the fuel otherwise overflowing from the pump work chamber via a metering line to a low-pressure chamber. A housing part receiving the quantity control valve and projecting laterally from the pump housing at the level of the pump housing, into which part the metering line leading to the pump work chamber extends, wherein lateral recesses on the projecting housing part are provided, which are engaged in forked fashion by a fastening cuff for the quantity control valve. The fastening cuff being provided with an internal thread and cooperating with a screw sleeve having an external thread.

10 Claims, 4 Drawing Sheets

ELECTRICALLY CONTROLLED FUEL INJECTION PUMP FOR INTERNAL COMBUSTION ENGINES IN PARTICULAR UNIT FUEL INJECTOR

BACKGROUND OF THE INVENTION

The invention relates to am electrically controlled fuel injection pump for internal combustion engines. In fuel injection devices of this kind, a pump piston, preferably driven by the engine camshaft, is disposed together with an associated injection nozzle in a common housing. The fuel injection quantity is controlled during the pump piston compression stroke by a quantity control valve, which for space reasons is secured to a laterally projecting housing part.

From a supply tank, fuel is pumped by a feed pump in a low-pressure chamber that communicates with the pump work chamber via a metering line. During the pump piston intake stroke, fuel flows at low pressure via the metering line into the pump work chamber, and during the compression stroke the fuel flows back again into the low-pressure chamber as long as this metering line is open. The quantity control valve is disposed in this metering line, so that in the blocked state, the pressure necessary for injections can build up in the pump work chamber.

Because of the high operating pressures of such fuel injection pumps, a particularly rigid connection between the quantity control value and the pump housing is necessary. In a known fuel injection pump of this generic type (U.S. Pat. No. 4,653,455), the quantity control valve is therefore secured to the projecting housing part, which has an external thread, with a union nut. This arrangement has the disadvantage, however, that providing an external thread on the pump housing is expensive, since in view of the high injection pressures the pump housing is of tempered steel. Another disadvantage is that with such an arrangement it is not possible to carry the metering line in a straight line from the pump work chamber to the quantity control valve; it is instead necessary to embody this portion of the metering line as a high-pressure bore bent twice at right angles. However, a metering line embodied in this way is unfavorable from a hydraulic standpoint, and rounding of the bends is difficult. Additionally, the problem arises of sealing off the bores from the outside in the high-pressure region.

ADVANTAGES OF THE INVENTION

The fuel injection pump according to the invention has the advantage over the prior art that no screw thread needs to be provided on the pumps housing for connecting the quantity control valve in a high-pressure-proof manner to the pump housing, and that the high-pressure segment of the metering line can be embodied as a rectilinear high-pressure bore that directly connects the pump work chamber to the quantity control valve. Instead of an expensively made external thread, the pump housing need merely be provided with lateral recesses, which for high-pressure-proof fastening of the quantity control valve to the pump housing are engaged in a forked manner by the fastening cuff, which is provided with an internal thread. Because of the absence of the external thread on the projecting housing part of the pump housing, it is possible to embody this housing part in such a way that there is sufficient room to receive the metering line in a direct connecting line between the quantity control valve and the pump work chamber. For this purpose, the fastening cuff is pushed onto the projecting housing part from the side remote from the pump piston, so that the side of the projecting housing part toward the pump piston is not covered by the fastening cuff, and the only constraint on its embodiment is the requirements of pressure conduit routing to the pump work chamber.

In an advantageous embodiment of the invention, the lateral recesses are embodied by two transverse grooves extending at right angles to the direction of reciprocation of the pump piston. The fastening cuff has a corresponding inner collar on its fork-like part, and is simply pushed from the side remote from the pump piston onto the projecting housing part. By tightening the screw sleeve, the quantity control valve is pressed against a sealing face provided on the projecting housing part, and the fastening cuff is simultaneously locked.

In another advantageous embodiment of the invention, the two transverse grooves extend from the side of the projecting housing part remote from the pump piston toward the pump piston, and a semi-annular groove connecting the two transverse grooves is provided on the side of the projecting housing part remote from the pump piston. This embodiment has the advantage that the fastening cuff can be supported with a large bearing surface area on the projecting housing part, without intersecting the direct connecting line between the quantity control valve and the pump work chamber.

In another advantageous embodiment of the invention the lateral recesses are embodied by at least three blind bores disposed uniformly in a plane at right angles to the longitudinal axis of the pump piston, a ball being seated in each of the blind bores and projecting in the other direction into a partial annular groove provided on the inside wall of the fastening cuff, and recesses associated with the blind bores are provided in the wall of the fastening cuff, through which recesses the balls can be removed when the fastening cuff is loose (FIGS. 7 and 8). In this embodiment, a high-pressure-proof fastening of the quantity control valve to the pump housing is assured without requiring that the fastening cuff have an inner collar. The result is a smaller outside diameter for this pump part.

In another advantageous embodiment of the invention, the lateral recesses are embodied by a first partial annular groove provided in the projecting housing part and by a second partial annular groove, provided parallel to the first partial annular groove and the projecting housing part and partly overlapping this first partial annular groove on its side toward the sealing face, which second partial annular groove is engaged by a snap ring biased radially outward, which in the other direction protrudes into a partial annular groove provided in the wall of the fastening cuff, the cross section of the first partial annular groove matching the cross section of the snap ring. In this embodiment as well, a high-pressure-proof connection between the quantity control valve and pump housing is assured without requiring the provision of an inner collar on the fastening cuff. Once again, this cuff part has a smaller outside diameter, and assembly is simpler than in the aforementioned embodiment.

In another embodiment of the invention, the projecting housing part, on its side toward the pump piston, has a portion converging obliquely toward the pump piston, and the metering line, extending through this oblique section, beginning at the quantity control valve, converges rectilinearly on the pump piston and then is bent at a right angle a maximum of one time in the direction toward the pump work chamber. As already noted above, the result has the advantage of avoiding hydraulically unfavorable right-angle bends. Moreover, high-pressure seals protecting against the outside are omitted, because all the bores for high-pressure lines can be made from surfaces that already provide high-pressure-proof sealing.

In another development of these characteristics, the metering line, beginning at the quantity control valve, is carried in the form of a continuously rectilinear high-pressure bore directly to the pump work chamber. In this embodiment, the high-pressure bore between the quantity control valve and the pump work chamber has no right-angle bends at all, and so no rounding operations need to be performed, and optimal flow conditions prevail.

Another advantage is that no seals are needed to seal off the high-pressure line from the outside.

Further advantages and advantageous embodiments of the invention can be found in the ensuing description, drawings and claims.

DRAWINGS

One exemplary embodiment of the subject of the invention is shown in the drawing and described in further detail hereinafter. Shown are: FIG. 1, a fuel injection pump with a fastening cuff for the quantity control valve, in a schematic view shown partly in section; FIG. 2, a fragmentary view of a variant of this fuel injection pump, again in a schematic view, partly in section; FIG. 3, a section taken along the line III—III in FIG. 1; FIG. 4, a plan view on the underside of a fastening cup according to the invention; FIG. 5, a section taken along the line V—V of FIG. 4; FIG. 6, a section taken along the line VI—VI of FIG. 5; FIG. 7, a section through a unit fuel injection with a variant of the fastening cuff, in a sectional view along the line VII—VII of FIG. 8; FIG. 8, a section through this fastening cuff along the line VIII—VIII of FIG. 7; FIG. 9, a view of a further variant corresponding to FIG. 7 and in a section taken along the line IX—IX of FIG. 10; and FIG. 10, a section taken along the line X—X of FIG. 9.

DESCRIPTION OF THE EXEMPLARY EMBODIMENTS

Figure 1:
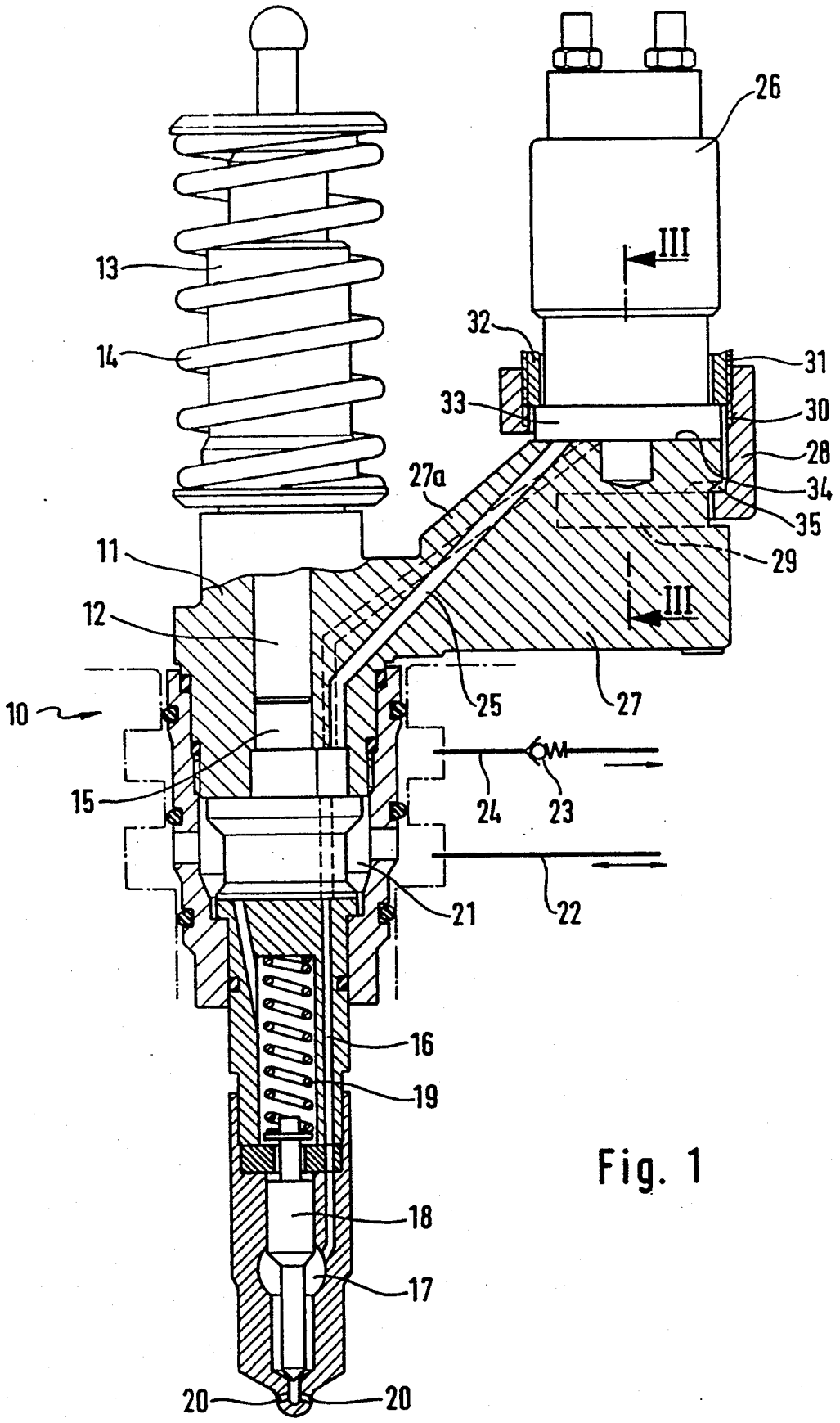

The unit fuel injector 10 according to the invention shown in FIG. 1 has a pump piston 12, guided in a pump housing 11, that is driven, with the interposition of a drive tappet 13, counter to the force of a restoring spring 14 by a drive element, not shown. With the pump housing 11, the pump piston 12 defines a pump work chamber 15, from which a pressure line 16 leads to a pressure chamber 17 in which a valve needle 18 of an injection nozzle 20 operates; at adequately high injection pressure, this needle (18) is displaced counter to the force of a closing spring 19 and in so doing uncovers injection ports **20*a* of the nozzle 20**, so that the fuel reaches the combustion chamber of the engine.

Between the pump piston 12 and the valve needle 18 in the pump housing, a low-pressure chamber 21 is provided, which is supplied with fuel via a metering line 22 by a feed pump, not shown. The pressure in the low-pressure chamber 21 is determined by a one-way pressure limiting valve 23 that is inserted into a return line 24. During an intake stroke of the pump piston 12, the pump work chamber 15 is supplied with fuel from the low-pressure chamber 21 and from the work chamber via an inlet line **25*a* and a metering line 25 to a quantity control valve 26. The quantity control valve 26 operates when closed to block the fuel flow from the work chamber 15 during a pressure stroke so that fuel is forced through the injection ports 20 to the cylinder, when the quantity control valve 26 opens, the flow of fuel is permitted to flow back the chamber and the injection ceases because of a lack of pressure. The quantity control valve 26 is disposed on a projecting housing part 27 of the pump housing 11 and is secured on it in a high-pressure-proof manner with the aid of a fastening cuff 28 that in forked fashion engages transverse grooves 29 provided on the housing part 27. The fastening cuff 28 is provided with an internal thread 30, into which a screw sleeve 32 provided with an external thread 31 is screwed. The screw sleeve 32 then engages an outer collar 33, provided on the quantity control valve 26, thereby pressing the quantity control valve 26 against a sealing face 34 provided on the projecting housing part 27. On its side remote from the pump piston 12, the projecting housing part 27 is provided with a semi-annular groove 35 that joins the transverse grooves 29, and that is also engaged by the securing cuff 28**.

In the exemplary embodiment of FIG. 1, shown, the metering line 25 extends between the quantity control valve 26 and the pump work chamber 15, beginning at the quantity control valve 26, first rectilinearly through the projecting housing part 27, and then discharges into a portion of the metering line 25 extending parallel to the reciprocation direction of the pump piston 12.

Figure 2:
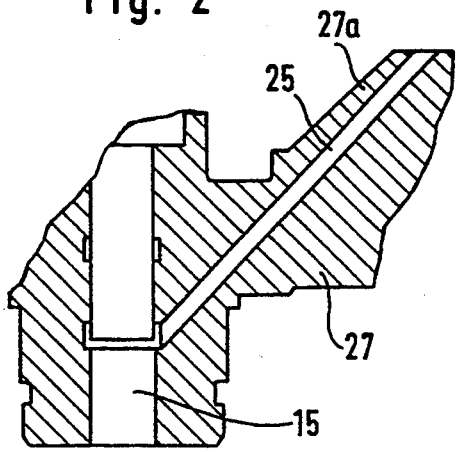

In the exemplary embodiment shown in FIG. 2, the metering line 25 extends continuously rectilinearly between the quantity control valve 26 and the pump work chamber 15. In both exemplary embodiments, the projecting housing part 27, on its side toward the pump piston 12, has a section **27*a*, which is embodied obliquely toward the pump piston, so that a metering line 25 that is bent at right angles once or not at all between the quantity control valve 26 and the pump work chamber 15** is possible.

Figure 3:
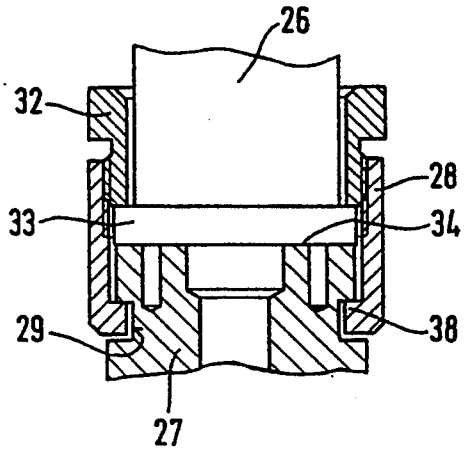
Figure 4:
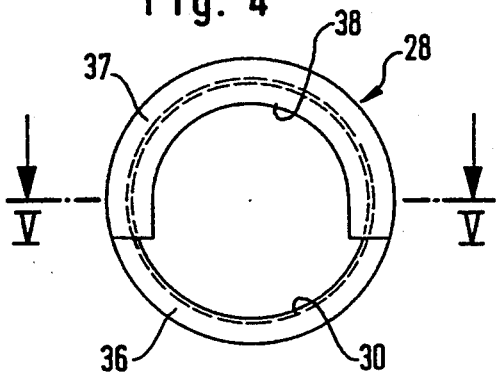
Figure 5:
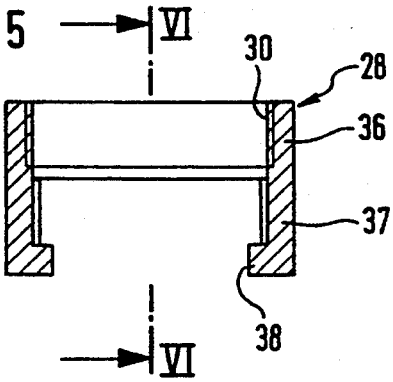
Figure 6:
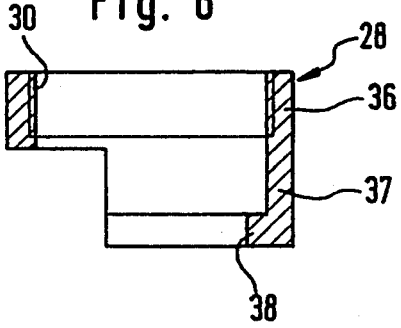

FIG. 3 shows the forked support of the fastening collar 28 on the projecting housing part 27. The fastening collar 28 itself is shown in FIGS. 4, 5 and 6. It has an annular region 36, provided with the internal thread 30, and this region is adjoined by a semi-annular region 37 lacking an internal thread. On its side remote from the annular region 36, the semi-annular region 37 is provided with an encompassing inner collar 38, with which the fastening cuff 28 is supported in the recesses 29 and 35 of the housing part 27.

To mount the quantity control valve 26 on the projecting housing part 27, the fastening cuff 28 is first inserted in forked fashion into the recesses 29 and 35; then the quantity control valve 26, the outside diameter of which is smaller than the clear inside diameter of the fastening cuff 28, is placed on the sealing face 34 of the housing part 27, and finally the screw sleeve 32 is inverted over the quantity control valves 26 and screwed into the internal thread 31 of the fastening cuff 28. As a result, the quantity control valve 26 is pressed against the sealing face 34 of the housing part 27 in a high-pressure-proof manner, with the recesses 29 and 35 serving as abutments for the fastening cuff 28.

Figure 8:
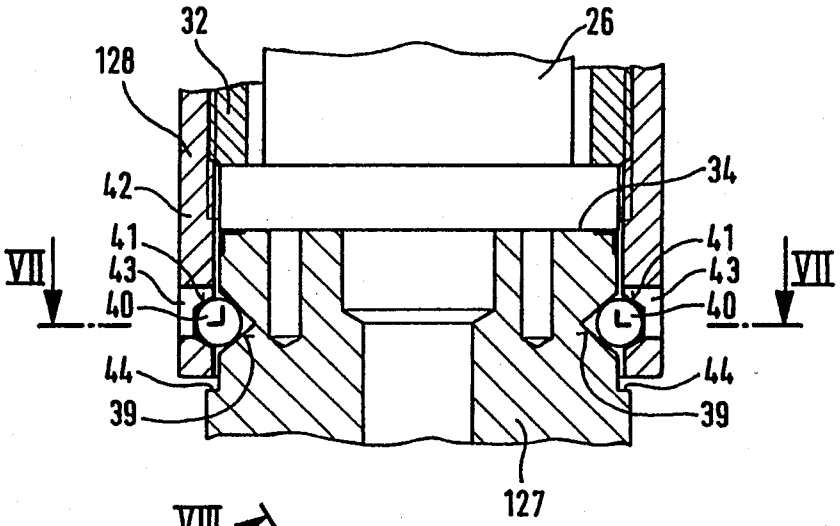
Figure 7:
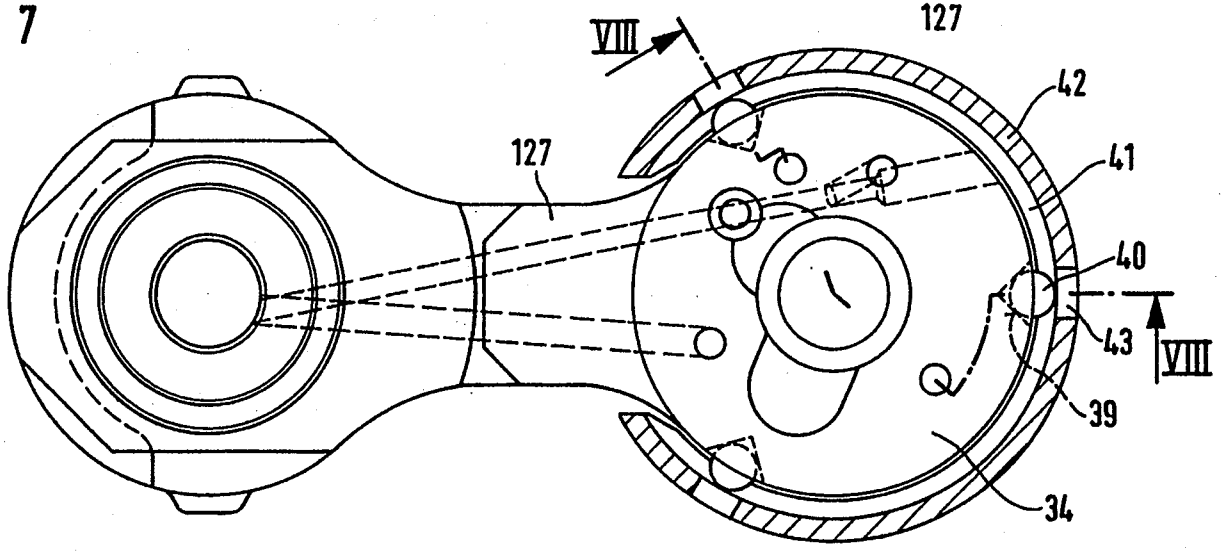

Another way of anchoring the fastening cuff 128 on the projecting housing part 127 is shown in FIGS. 7 and 8. In this variant, the lateral recesses in the projecting housing part 127 are embodied as conical blind bores 39, in each of which a ball 40 is supported. These balls 40 and the associated blind bores 39 are disposed uniformly in a plane, laterally of the projecting housing part 127, that is vertical to the direction of reciprocation of the pump piston 12. The balls 40, which plunge into the conical blind bores 39 to approximately half their diameter, extend in the other direction into a partial annular groove 41 provided in the wall of the fastening cuff 128; this partial annular groove extends in the partial annular region 42, encompassing the projecting housing part 127, of the fastening cuff 128 in a plane that is likewise vertical to the direction of reciprocation of the pump piston 12.

Three recesses 43 are provided in the wall of the partial region 42 of the fastening cuff 128, in a plane that is parallel to the partial annular groove 41 and is offset somewhat from the annular region 136 of the fastening cuff 126, and these recesses are disposed in such a way in this plane that they are opposite the balls 40. Parallel to the sealing face 34, the projecting housing part 127 has a shoulder 44 on which the fastening cuff 128 is seated when the screw sleeve 32 is loosened. The spacing of this shoulder 44 from the sealing face 34 is selected Such that with the fastening cuff 128 seated on it, the recesses 43 are in alignment with the associated balls 40.

In this variant, to mount the quantity control valve 26, the fastening cuff 128 is inverted over the projecting housing part 127 and is seated on its shoulder 44. The recesses 43 in the wall of the fastening cuff 128 are in alignment in this position with the conical blind bores 39, so that the balls 40 can be placed in them. Then the screw sleeve 32 is inverted over the quantity control valve 26 and screwed into the fastening cuff 128. By tightening this screw connection, the quantity control valve 26 is pressed against the sealing face 34, in the course of which the fastening cuff 128 is anchored by the balls 40 that are supported on one side in the conical blind bores 39 and on the other in the partial annular groove 41. In this position, the recesses 43 are no longer aligned with the blind bores 39, and so the balls 40 cannot fall out.

Figure 10:
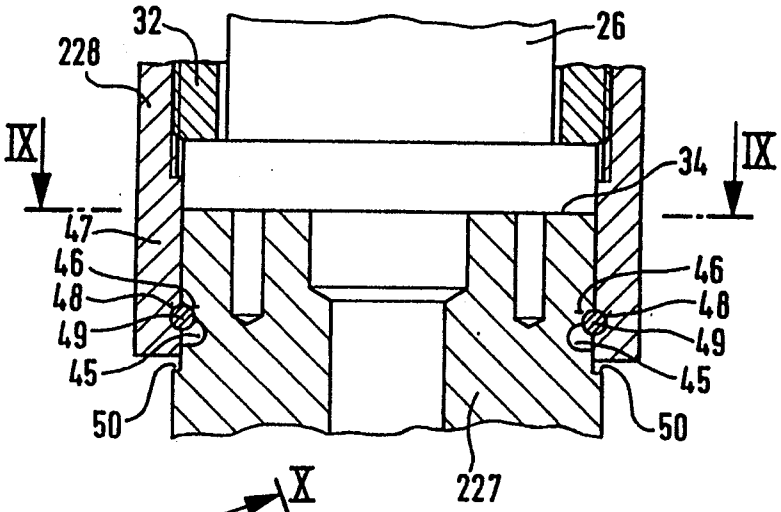
Figure 9:
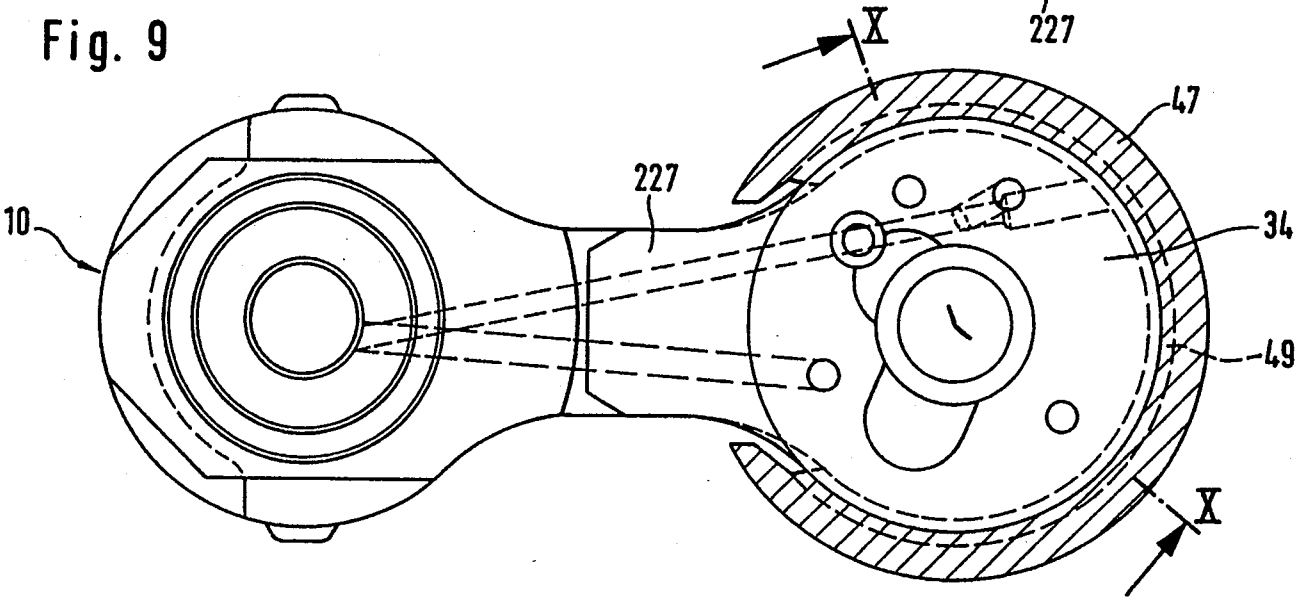

A further variant for anchoring the fastening cuff 228 on the projecting housing part 227 is shown in FIGS. 9 and 10. In this variant, a first partial annular groove 45 parallel to the sealing face 34 and a second partial annular groove 46, likewise parallel to it and partly overlapping the first partial annular groove 45, are provided as a lateral recess on the projecting housing part 227; however, the cross section of the second partial annular groove 46 is smaller by half than the cross section of the first partial annular groove 45 and is disposed offset somewhat in the direction toward the sealing face 34 from the first partial annular groove 45. A partial annular groove 48, the cross section of which matches the cross section of the second partial annular groove 46, is likewise provided on the inside wall of the partial annular region 47 of the fastening cuff 228. The cross section of the first partial annular groove 45 matches the cross section of a snap ring 49, which is radially outwardly prestressed and which in the assembled state is supported on one side in the second partial annular groove 46 provided in the projecting housing part 227 and on the other in the partial annular groove 48 provided in the fastening cuff 228.

Prior to assembly, however, the snap ring 49 is received by the first partial annular groove 45 provided in the projecting housing part; the prestressing of the snap ring 49 is equalized with the aid of a tool, so that the fastening cuff 228 can be inverted over the projecting housing part 227. To simplify the assembly, the fastening cuff 228 is supported in this process on a shoulder 50 provided on the projecting housing part 227 parallel to the sealing face 34; the spacing of this shoulder from the sealing face 34 is dimensioned such that the partial annular groove 48 provided in the wall of the fastening cuff 228 is in alignment, in this position, with the first partial annular groove 45 and the projecting housing part 227. By screwing in the screw sleeve 32, the quantity control valve 26 is pressed against the sealing face 34, causing the snap ring 49 to snap out of the first partial annular groove 45 into the second partial annular groove 46. In this position, the snap ring 49 simultaneously extends into the partial annular groove 48, so that the fastening cuff 228 is anchored.

All the characteristics shown in the description, the ensuing claims and the drawing can be essential to the invention both individually and in any arbitrary combination with one another.

We claim:

1. An electrically controlled fuel injection pump for internal combustion engines comprising, a housing (11) including a projecting housing part (27), a pump cylinder disposed in said pump housing, a pump piston guided in the pump cylinder, said pump piston defining a pump work chamber, a feed pump that delivers a fuel inflow to a low pressure chamber 21 from which the fuel flows to said pump work chamber, an injection nozzle secured to said housing in axial alignment with said pump piston, a quantity control valve secured to said projecting housing part, a fuel metering line in said projecting housing part between said pump work chamber and said quantity control valve, during a pumping stroke said pump piston pumps fuel delivered to said pump work chamber at inflow pressure by said feed pump to said injection nozzle at an injection pressure, as long as said quantity control valve blocks a flow of the fuel from said pump work chamber via said metering line over to said low-pressure chamber, said quantity control valve includes an outer collar (33) which seats against a sealing face (34) on said projecting housing part by which said quantity control valve is secured to said projecting housing part by a fastening cuff (28), said fastening cuff includes a cylindrical portion (36) including internal screw threads (30) on its inner surface and a substantially semi-annular portion which is provided with at least one inwardly extending rib (38), said projecting housing part is provided with lateral recesses (29) which are engaged in forked fashion by said at least one inwardly extending rib of said fastening cuff (28) with said cylindrical portion of said fastening cuff above said projecting housing part for receipt of one end of said quantity control valve (26), and a cooperating screw sleeve (32) having an external thread (31) that surrounds said quantity control valve above said outer collar (33) and is threaded into said internal screw threads on the inner surface of said fastening cuff (28) to secure said quantity control valve to said projecting housing part.

2. A fuel injection pump as defined by claim 1, in which the lateral recesses are embodied by two transverse grooves (29) extending at right angles to the direction of reciprocation of the pump piston (12).

3. A fuel injection pump as defined by claim 2, in which the two transverse grooves (29) extend from a side of the projecting housing part (27) remote from the pump piston (12) toward the pump piston (12), and that a semi-annular groove (35) connecting the two, transverse grooves (29) is provided on the side of the projecting housing part (27) remote from the pump piston (12).

4. A fuel injection pump as defined by claim 10, in which the projecting housing part (27), on a side toward the pump piston (12), has a portion (27*a*) that converges obliquely toward the pump piston (12), and that the metering line (25), extending through this oblique section (27*a*), begins at the quantity control valve (26) and extends rectilinearly toward the pump piston (12) and includes a portion parallel with the pump piston which extends toward the pump work chamber (15).

5. A fuel injection pump as defined by claim 4, in which the metering line (25), beginning at the quantity control valve (26), is carried in the form of a continuously rectilinear high-pressure bore directly to the pump work chamber (15).

6. A fuel injection pump as defined by claim 2, in which the projecting housing part (27), on a side toward the pump piston (12), has a portion (27*a*) that converges obliquely toward the pump piston (12), and that the metering line (25), extending through this oblique section (27*a*), begins at the quantity control valve (26) and extends rectilinearly toward the pump piston (12) and includes a portion parallel with the pump piston which extends toward the pump Work chamber (15).

7. A fuel injection pump as defined by claim 6, in which the metering line (25), beginning at the quantity control valve (26), is carried in the form of a continuously rectilinear high-pressure bore directly to the pump work chamber (15).

8. A fuel injection pump as defined by claim 1, in which the projecting housing part (27), on a side toward the pump piston (12), has a portion (27*a*) that converges obliquely toward the pump piston (12), and that the metering line (25), extending through this oblique section (27*a*), begins at the quantity control valve (26) and extends rectilinearly toward the pump piston (12) and includes a portion parallel with the pump piston which extends toward the pump work chamber (15).

9. A fuel injection pump as defined by claim 8, in which the metering line (25), beginning at the quantity control valve (26), is carried in the form of a continuously rectilinear high-pressure bore directly to the pump work chamber (15).

10. A fastening unit for securing a quantity control valve onto a projecting housing part of an electrically controlled fuel injection pump for internal combustion engines, which comprises a fastening cuff (28) and a cooperating screw sleeve (32), said fastening cuff (28) includes a substantially semi-annular portion (37) and an annular portion (36), said semi-annular portion includes at least one inwardly extending rib (38) and said annular portion includes screw threads (30) on its inner surface, said cooperating screw sleeve (32) includes external screw threads on one end which cooperate with said internal threads (30) on said fastening cuff for securing said quantity control valve onto a seat face of said projecting housing part.

* * * * *